US010818447B2

(12) United States Patent
Chen et al.

(10) Patent No.: US 10,818,447 B2
(45) Date of Patent: Oct. 27, 2020

(54) PREPARATION METHOD OF RAPID COMPOSITE OF LONG SILVER-GRAPHITE ELECTRICAL CONTACT MATERIAL AND SOLDER STRIP MATERIAL

(71) Applicant: WENZHOU HONGFENG ELECTRICAL ALLOY CO., LTD, Wenzhou (CN)

(72) Inventors: Xiao Chen, Wenzhou (CN); Xinhe Wu, Wenzhou (CN); Chengfa Mu, Wenzhou (CN); Kaixu Wang, Wenzhou (CN); Pengju Lv, Wenzhou (CN)

(73) Assignee: WENZHOU HONGFENG ELECTRICAL ALLOY CO., LTD, Wenzhou (CN)

( * ) Notice: Subject to any disclaimer, the term of this patent is extended or adjusted under 35 U.S.C. 154(b) by 0 days.

(21) Appl. No.: 16/760,452

(22) PCT Filed: Nov. 14, 2018

(86) PCT No.: PCT/CN2018/115333
§ 371 (c)(1),
(2) Date: Apr. 30, 2020

(87) PCT Pub. No.: WO2019/100976
PCT Pub. Date: May 31, 2019

(65) Prior Publication Data

US 2020/0294734 A1 Sep. 17, 2020

(30) Foreign Application Priority Data

Nov. 23, 2017 (CN) ..... 2017 1 1177988

(51) Int. Cl.
*H01R 43/04* (2006.01)
*H01H 11/06* (2006.01)

(52) U.S. Cl.
CPC ..... *H01H 11/06* (2013.01); *H01H 2011/067* (2013.01); *Y10T 29/49204* (2015.01); *Y10T 29/49218* (2015.01)

(58) Field of Classification Search
USPC ..... 29/882, 825, 874, 878
See application file for complete search history.

(56) References Cited

U.S. PATENT DOCUMENTS 4,240,830 A * 12/1980 Lee ..... C04B 35/52 419/28
7,754,280 B2 * 7/2010 Kempf ..... C22C 32/0084 427/213.31

FOREIGN PATENT DOCUMENTS

CN 101693955 A 4/2010
CN 102237205 A 11/2011
(Continued)

*Primary Examiner* — Thiem D Phan
(74) *Attorney, Agent, or Firm* — Andrew C. Cheng

(57) ABSTRACT

A preparation method of a rapid bonding of a long silver-graphite electrical contact material and a solder strip material includes the following steps: first step, making a silver-graphite spindle into a silver-graphite electrical contact sheet material by an extrusion process; second step, performing a sintering to composite a solder strip material with the silver-graphite electrical contact sheet material to obtain a composite blank; and third step, performing a rolling and a heat treatment on the composite blank for one or more times to complete the composite of the long silver-graphite electrical contact material and the solder strip material. The method is a method for preparing a silver-based electrical contact material and solder composite material.

12 Claims, 2 Drawing Sheets

(56) References Cited

FOREIGN PATENT DOCUMENTS

| | | | |
|---|---|---|---|
| CN | 105405685 | A | 3/2016 |
| CN | 106098443 | A | 11/2016 |
| CN | 106475651 | A | 3/2017 |
| CN | 207977242 | U | 10/2018 |

* cited by examiner

PREPARATION METHOD OF RAPID COMPOSITE OF LONG SILVER-GRAPHITE ELECTRICAL CONTACT MATERIAL AND SOLDER STRIP MATERIAL

CROSS REFERENCE TO THE RELATED APPLICATIONS

This application is the national phase entry of International Application No. PCT/CN2018/115333, filed on Nov. 14, 2018, which is based upon and claims priority to Chinese Patent Application No. 201711177988.9, filed on Nov. 23, 2017, the entire contents of which are incorporated herein by reference.

TECHNICAL FIELD

The present invention discloses a preparation method of an electrical contact material and solder cladding. More specifically, the present invention relates to the technical fields of preparation of low-voltage electrical contact materials and material processing, particularly a short-flow and high-efficiency preparation method of a rapid composite of a long silver-based electrical contact material and a solder strip material.

BACKGROUND

Electrical contact material is an important element of switching devices which is responsible for making, breaking, carrying and isolating current. The brazing technique is a widely used technique to effectively solder an electrical contact material with a contact bridge and a contact plate. The brazing quality greatly influences the reliability of electrical appliances, electric-arc burning loss and service life of electrical contacts, especially for electrical contacts of a large-capacity switch. The properties and soldering quality of electrical contact materials directly affect the safety, reliability and service life of switching devices.

Silver-based or copper-based materials are commonly used in electrical contact materials. For example, Ag or CuNi is used as soldering material when preparing AgWCC-based electrical contact materials, AgWCC or AgNi powder and Ag or CuNi powder are placed in the mold cavity, and AgWCC/Ag materials are prepared by cold pressing technology.

A decarburization technique is typically used on the different shapes and sizes silver-graphite electrical contact materials prepared by powder metallurgy to remove the graphite on the surface of the silver-graphite materials to produce a thin layer of pure silver as the welding layer. The thickness and uniformity of the pure silver layer is mainly determined by the parameters of decarburization temperature, time and atmospheric. In order to ensure that the silver-graphite material has reliable welding quality and high consistency, the welding layer needs to have the thickness of pure silver layer control and good thickness consistency, etc., which requires precise process control parameters, large energy consumption of equipment and time-consuming production. Decarburization technology is suitable for making granular and small pieces of silver-graphite electrical contact materials, but is not suitable for continuous strip of silver-graphite electrical contact materials.

Compared with electrical contacts with soldering flux or solder paste, electrical contact materials with solder layers are easier to achieve soldering automation in the field of electrical contact materials, improving production efficiency and reducing production costs.

According to the search results, Chinese Patent, having a patent number of ZL200910153565.2, discloses a method for preparing a silver-graphite electrical contact strip material, which includes coating a silver layer on an outer side of a silver-graphite spindle, and then performing a silver composite process under extrusion pressure to prepare a thickness-controllable composite silver-silver-graphite strip material with a composite silver layer. However, the method has the following disadvantages:

1. In the above patent, a silver-graphite spindle is coated with a silver layer on the periphery, and is maintained at 720-830° C. for 2-3 hours; then, extrusion is performed to prepare a silver-graphite strip material with a composite silver layer (the strip material has a two-layer structure on the metallographic phase, namely an AgC layer and a pure silver layer). During the hot-sintering process of the silver-graphite spindle coating with the silver layer, binding the cylindrical interface of the silver-graphite spindle with the cylindrical interface of the pure silver layer is difficult, there are many unbonded regions, and many holes exist in the bonding region. During the extrusion, the interface without densification often causes the outer coating layer, i.e., the pure silver layer to peel and fall off, thus, the interface bonding strength is weak, a continuous pure silver layer cannot be formed on the extruded silver-graphite strip material, and the yield is low.

2. In the above patent, in order to obtain a pure silver layer with controllable thickness, when the extrusion is performed on the outer coating layer, i.e., the pure silver layer, a part of the outer coating layer, i.e., the pure silver layer, turns to a waste material, forming a hollow cylindrical pure silver material; and the rest of the coating layers form a pure silver layer after the extrusion. The utilization rate of the coating layer, i.e., the pure silver layer, is low.

3. In the above patent, the silver-graphite strip material with a pure silver layer obtained after extruding the spindle can be inferred to have a three-layer structure. The silver-graphite material is located between the upper and lower layers of pure silver, that is, the silver-graphite strip material has an AgAgC/Ag structure. This results in the need to remove one layer of pure silver, such as subsequent polishing, which is similar to removing the pure silver layer after the decarburization of the silver-graphite. The silver-graphite is exposed as a working layer, and the subsequent processing is difficult and time-consuming.

4. In the above patent, the silver-graphite spindle is coated with the pure silver layer, and is subjected to extrusion to obtain the silver-graphite strip material with the pure silver layer. For preparing a strip material having uniform thickness and thickness-controllable pure silver layer, a relatively high level of extrusion and operation skills are required.

SUMMARY

In view of the drawbacks of the prior art, the objective of the present invention is to provide a short-flow and high-efficiency preparation method of a rapid composite of a long silver-graphite electrical contact material and a solder strip material, which can solve the above-mentioned technical problems, and has the advantages of simple operation, simplified process, and high yield.

To achieve the above objective, the preparation method of the rapid composite of the long silver-graphite electrical contact material and the solder strip material according to the present invention includes the following steps:

first step, making a silver-graphite spindle into a silver-graphite electrical contact sheet material by an extrusion process;

second step, performing a sintering to composite a solder strip material with the silver-graphite electrical contact sheet material to obtain a composite blank; and third step, performing a rolling and a heat treatment on the composite blank for one or more times to complete the composite of the long silver-graphite electrical contact material and the solder strip material.

Preferably, in the first step, the extrusion process is a hot extrusion, a sintering temperature of the silver-graphite spindle is 600° C.-800° C., and a sintering time is 1-5 h.

Preferably, in the first step, the silver-graphite electrical contact sheet material has a U-shaped structure with a stuck slot.

Preferably, in the first step, the silver-graphite electrical contact sheet material has a length of 5-50 in.

More preferably, the stuck slot sticks the long silver-graphite sheet material and the solder strip material, so that surfaces of the long silver-graphite sheet material and the solder strip material contact with each other closely, and the solder strip material can cover the stuck slot to form a good solder layer during the sintering.

The extruded silver-graphite sheet material of the present invention has a relatively long length of 5-50 m, and the silver-graphite is soft. After the solder strip material is stuck in the stuck slot, the silver-graphite sheet material can be rolled into bundles for sintering to achieve the composite, thereby improving the production efficiency of the long silver-graphite. In addition, the stuck slot can prevent the solder from falling off. Generally, in mass production, silver-graphite wire material or silver-graphite strip material is obtained by extrusion of the silver-graphite spindle, and then punching is performed to obtain granular or flake silver-graphite; and then the granular or flake silver-graphite is decarburized to form a near-pure silver layer to obtain a silver-graphite electrical contact material. The thickness of the decarburized layer is uneven. That is, the finished product is obtained by the steps of extrusion for preparing the wire material, punching into a small piece, decarburization, and subsequent treatment, such as removing the pure silver layer on the working surface, shaping and densification, and others. However, in the present invention, the long silver-graphite sheet material is used, and after sintered and composited with solder, the thickness of the solder layer can be made uniform by rolling, and the thickness can be controlled. That is, the finished product is obtained by the steps of extrusion for preparing sheet material, compositing solder, and punching. The whole method is simple in operation, simplified in process, and high in yield.

Preferably, in the second step, the solder strip material is stuck in the stuck slot of the long silver-graphite sheet material for sintering to composite the sheet material with the solder, the sintering temperature is 600° C.-800° C., and the protective atmosphere is hydrogen. The sintering temperature selected here reaches the melting point of the solder strip, so that the solder melts and covers the stuck slot, and a solder layer is formed after cooling.

Preferably, in the third step, the rolling is a cold rolling, so that the silver-graphite sheet material and the solder strip material can be bonded densely after being composited, and the composite silver-graphite is rolled to have a desired thickness of the finished product.

Preferably, in the third step, the heat treatment is a diffusion annealing, and the temperature is 400° C.-600° C., and the time is 0.5-3 h. The diffusion annealing can eliminate internal stress during the rolling, and eliminate defects such as deformation and cracking caused by a stress relief.

Further, after the composite of the long silver-graphite electrical contact material and the solder strip material is completed, punching is further performed to obtain an electrical contact material with a solder layer.

The punching is to punch the silver-graphite material rolled to a thickness of the finished product into outer dimensions of a desired product.

Compared with the prior art, the present invention has the following advantages:

1. According to the method of the rapid composite of the long silver-graphite electrical contact material and the solder strip material of the present invention, the melting point of the solder strip material is 600° C.-800° C., which is lower than the melting point (about 961° C.) of silver. Further, a solder strip material having a relatively high silver content can be selected. The solder melted at a medium temperature has a good wettability with silver-graphite, and can extend on the surface of silver-graphite, so as to form a solder layer with good surface quality.

2. The melted solder can be confined to the position of the stuck slot without flowing to the side of the sheet material. There is no solder on the side and the appearance is beautiful.

3. Since the thickness of the prepared solder strip material is uniform and controllable, the sintering is performed on the long silver-graphite sheet material to composite the long silver-graphite sheet material with the solder, achieving a uniform distribution and a controllable thickness of the solder layer on the surface of the silver-graphite.

4. In the prior art, silver-graphite is usually prepared by decarburization technology, the decarburized layer can be used as a solder layer, and the thickness of the solder layer is uneven. Alternatively, after decarburization, the silver-graphite is composited with solder and then used as a solder layer, and the process is cumbersome. In the present invention, the solder is composited with the silver-graphite by sintering instead of decarburizing or rolling, the process is simplified, and the production efficiency is high.

5. In the present invention, a silver-graphite sheet material with solder is prepared first, and then subjected to punching to obtain a finished product. The finished product has a high dimensional accuracy without the need for dimensional screening, and an automatic soldering can be realized.

In summary, according to the present invention, a highly efficient and continuous composite of a long silver-graphite electric contact sheet material and a solder strip material is realized, products with good interface bonding quality and high dimensional accuracy are produced, the thickness of solder layer is more consistent, and continuity and short process is realized, which facilitates the realization of soldering automation, with significant economic benefits.

BRIEF DESCRIPTION OF THE DRAWINGS

Other features, objectives and advantages of the present invention will become more apparent by reading and referring to the below detailed description of drawings regarding the non-limiting embodiments.

DETAILED DESCRIPTION OF THE EMBODIMENTS

The present invention will be described in detail below with reference to specific embodiments. The following embodiments are intended to assist those skilled in the art to further understand the present invention, rather than to limit the present invention in any way. It should be noted that some variations and improvements may be made by those skilled in the art without departing from the inventive conception of the present invention. These variations and improvements are all within the protection scope of the present invention.

Figure 1:
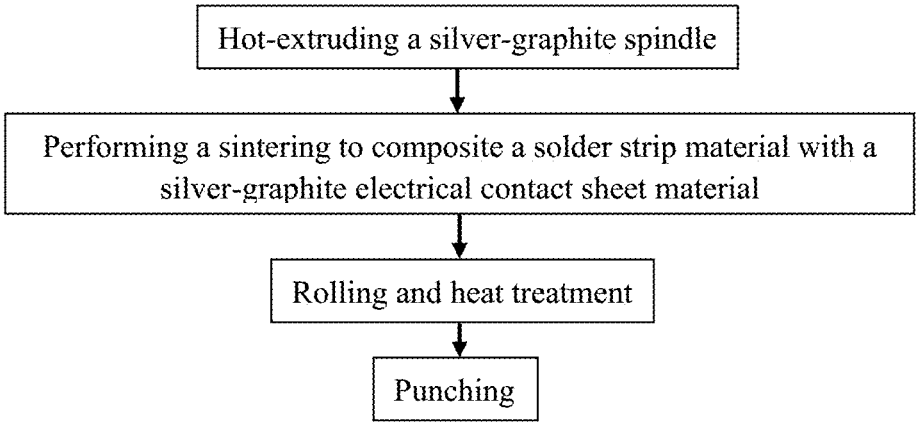
FIG. 1 is a process flow diagram of a preparation method according to an embodiment of the present invention.

As shown in FIG. 1, the preparation method in the following embodiments of the present invention is implemented according to the process flow shown in FIG. 1.

Embodiment 1

Figure 2:
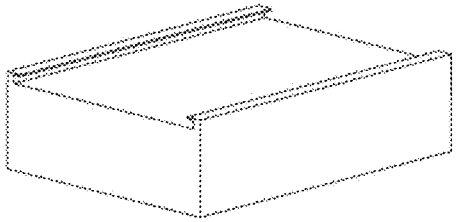
FIG. 2 is a schematic diagram showing a main structure of an AgC sheet material having a U-shaped structure with a stuck slot formed by a hot extrusion of an AgC spindle according to an embodiment of the present invention.

The preparation of AgC4 electrical contact material is taken as an example, and the specific preparation includes the following steps:

(1) an AgC4 spindle with a diameter of 90 mm is prepared by a powder metallurgy technology; after sintering at 750° C. for 3 h, a hot extrusion is carried out to obtain a long continuous AgC4 sheet material with a stuck slot structure shown in FIG. 2; the sheet material has a thickness of 2.1 mm and a length of 35-45 m;

(2) a BCu88PAg solder stripe material is evenly stuck in the stuck slot of the AgC4 sheet material, and the sintering is performed to composite the AgC4 sheet material with the solder stripe material; a sintering temperature is 730° C., and a protective atmosphere is hydrogen, so that AgC4 sheet material is tightly bonded with the solder stripe material;

(3) the AgC4 sheet material composited with the solder stripe material is subjected to multiple times of cold rolling and annealing heat treatment, and then rolled to a desired thickness of a finished product;

in this step, a deformation amount of each time of cold rolling is 12%-16%, an annealing temperature is 500° C., an annealing time is 1 h, and the protective atmosphere is hydrogen; and (4) after performing a punching, a finished product of AgC4 electrical contact material with a desired outer dimension is obtained.

Embodiment 2

The preparation of AgC3 electrical contact material is taken as an example, and the specific preparation includes the following steps:

(1) an AgC3 spindle with a diameter of 100 mm is prepared by a powder metallurgy technology; after sintering at 740° C. for 3.5 h, a hot extrusion is carried out to obtain a long AgC3 sheet material having a U-shaped structure with a stuck slot; the sheet material has a thickness of 3.3 mm and a length of 25-35 m;

(2) a BAg25CuZn solder stripe material is evenly and flatly stuck in the stuck slot for sintering to composite the AgC3 sheet material with the solder stripe material; a temperature is 740° C., and a protective atmosphere is hydrogen, so that AgC3 sheet material is tightly bonded with the solder stripe material;

(3) the AgC3 sheet material composited with the solder stripe material is subjected to multiple times of cold rolling and annealing heat treatment, and then rolled to a desired thickness of a finished product;

in this step, a deformation amount of each time of cold rolling is 15%-20%, an annealing temperature is 490° C., an annealing time is 1.5 h, and the protective atmosphere is hydrogen; and (4) after performing a punching, a finished product of AgC3 electrical contact material with a desired specification, such as a round tip, is obtained.

Embodiment 3

The preparation of AgC5 electrical contact material is taken as an example, and the specific preparation includes the following steps:

(1) an AgC5 spindle with a diameter of 100 mm is prepared by a powder metallurgy technology; after sintering at 760° C. for 3 h, a hot extrusion is carried out to obtain a long AgC5 sheet material having a U-shaped structure with a stuck slot; the sheet material has a thickness of 3.4 mm and a length of 25-35 m;

(2) a BAg30CuZnSn solder stripe material is evenly and flatly stuck in the stuck slot of the AgC5 sheet material for sintering to composite the AgC5 sheet material with the solder stripe material; a temperature is 770° C., and a protective atmosphere is hydrogen, so that the AgC5 sheet material is tightly bonded with the solder stripe material;

(3) the AgC5 sheet material composited with the solder stripe material is subjected to multiple times of cold rolling and annealing heat treatment, and then rolled to a desired thickness of a finished product;

in this step, a deformation amount of each time of cold rolling is 15%-20%, an annealing temperature is 495° C., an annealing time is 2 h, and the protective atmosphere is hydrogen; and (4) after performing a punching, a finished product of AgC5 electrical contact material with a desired specification is obtained.

Referring to FIG. 2, a silver-graphite sheet material after a hot extrusion according to an embodiment of the present invention is shown. The sheet material is U-shaped and has a stuck slot structure. The height of the stuck slot depends on the thickness of the solder strip material. In one embodiment, the height of the stuck slot can be 0.02 to 0.04 mm larger than the thickness of the solder strip material, so as to ensure that the solder strip material is stuck tightly, thus making the interfaces of the silver-graphite and the solder strip material bonded tightly when performing the sintering to composite the silver-graphite and the solder strip material. In the present invention, the stuck slot can make the long silver-graphite sheet material stuck with the solder strip material, so that the surfaces of the long silver-graphite sheet material and the solder strip material contact with each other closely, and the solder strip material can cover the stuck slot to form a good solder layer during the sintering. Moreover, the extruded silver-graphite sheet material of the present invention is relatively long, and the silver-graphite is soft. After the solder strip material is stuck in the stuck slot, the silver-graphite sheet material can be rolled into bundles for sintering to achieve the composite, thereby improving the production efficiency of the long silver-graphite. In addition, the stuck slot can prevent the solder from falling off.

In the present invention, after the long silver-graphite sheet material is sintered and composited with solder, the thickness of the solder layer can be made uniform by rolling, and the thickness can be controlled. That is, the finished product is obtained by the steps of extrusion for preparing sheet material, compositing solder, and punching.

Figure 3:
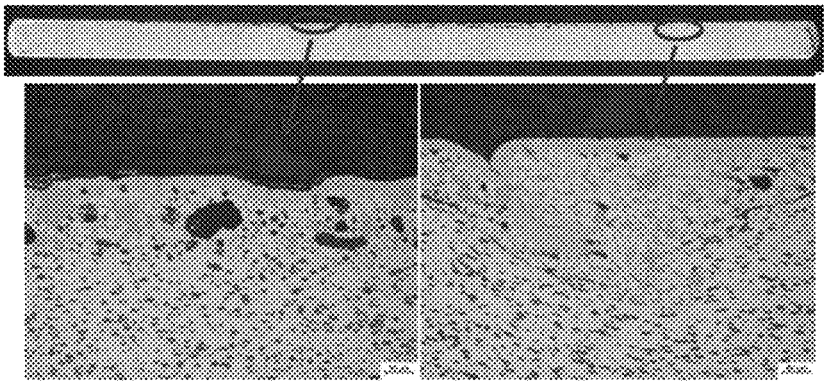
FIG. 3 shows a metallographic photograph (left) of a cross section of a long AgC3 sheet material composited with a solder strip material after a sintering according to an embodiment of the present invention, and a metallographic photograph (right) of a solder layer and a stuck slot portion with a magnification of 200×.

Referring to FIG. 3, and according to the above embodiments, in the silver-graphite electrical contact sheet material after sintered and composited with solder strip material prepared by the present invention, the interfaces of the silver-graphite sheet material and the solder strip material are bonded tightly, and the middle portion is a porous structure formed by sintering of the solder strip material. Subsequent rolling can make the solder strip material compact.

Figure 4:
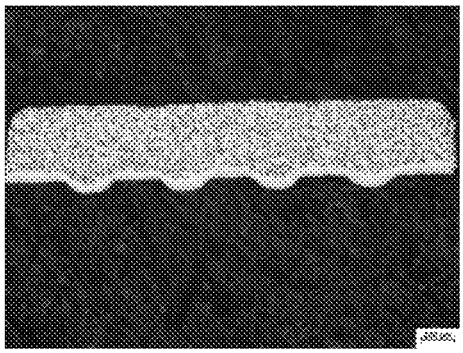
FIG. 4 is a metallographic photograph of a finished product of an AgC4 electrical contact material according to an embodiment of the present invention.

Referring to FIG. 4, a metallographic photograph of a finished product of AgC4 electrical contact material according to the embodiment of the present invention is shown. The interface is densely bonded, and the thickness of the solder layer is uniform.

In the above embodiments of the present invention, the steps of extrusion, sintering, cold rolling and heat treatment are used for preparation, which is beneficial for shortening the cycle, improving the production efficiency and saving the production cost.

According to the present invention, a good dense silver-graphite sheet material can be obtained by extruding a pure silver-graphite spindle. After the good dense silver-graphite sheet material is sintered and composited with a solder strip material, a desired silver-graphite material can be obtained by rolling and heat treatment. Compared with the prior art (including Chinese Patent ZL200910153565.2), the method of the present invention has the advantages of simple operation, simplified process, and high yield.

According to the present invention, a highly efficient and continuous composite of a long silver-graphite electric contact sheet material and a solder strip material is realized, products with good interface bonding quality and high dimensional accuracy are produced, the thickness of solder layer has high consistency, and continuity and short process is realized, which facilitates the realization of soldering automation, with significant economic benefits.

The specific embodiments of the present invention have been described above. It should be understood that the present invention is not limited to the specific embodiments described above, and various modifications and variations may be made by those skilled in the art within the scope of the pending claims, which do not affect the essential contents of the present invention.

What is claimed is:

1. A preparation method of a rapid composite of a long silver-graphite electrical contact material and a solder strip material, comprising the following steps:

first step, making a silver-graphite spindle into a silver-graphite electrical contact sheet material by an extrusion process;

second step, performing a sintering to composite a solder strip material with the silver-graphite electrical contact sheet material to obtain a composite blank; and third step, performing a rolling and a heat treatment on the composite blank for one or more times to complete the rapid composite of the long silver-graphite electrical contact material and the solder strip material;

wherein in the first step, the extrusion process is a hot extrusion, a sintering temperature of the silver-graphite spindle is 600° C.-800° C., and a sintering time is 1-5 h;

wherein in the first step, the silver-graphite electrical contact sheet material has a U-shaped structure with a stuck slot, and the stuck slot makes the long silver-graphite sheet material stuck with the solder strip material, so that surfaces of the long silver-graphite sheet material and the solder strip material contact with each other closely; and during the sintering in the second step, the solder strip material covers the stuck slot to form a good solder layer;

wherein in the second step, a temperature of the sintering is 600° C.-800° C., and a protective atmosphere for the sintering is hydrogen:

wherein in the third step, the rolling is a cold rolling, so that the silver-graphite sheet material and the solder strip material are bonded densely after being composited, and the composite silver-graphite is rolled to a desired thickness of a finished product:

wherein the heat treatment is a diffusion annealing; a temperature of the diffusion annealing is 400° C.-600° C., and a time of the diffusion annealing is 0.5-3 h.

2. The preparation method of the rapid composite of the long silver-graphite electrical contact material and the solder strip material according to claim 1, wherein the silver-graphite electrical contact sheet material has a length of 5-50 m.

3. The preparation method of the rapid composite of the long silver-graphite electrical contact material and the solder strip material according to claim 2, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

4. The preparation method of the rapid composite of the long silver-graphite electrical contact material and the solder strip material according to claim 1, wherein in the second step, the solder strip material is stuck in the stuck slot of the long silver-graphite sheet material for the sintering to achieve the rapid composite.

5. The preparation method of the rapid composite of the long silver-graphite electrical contact material and the solder strip material according to claim 4, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

6. The preparation method of the rapid composite of the long silver-graphite electrical contact material and the solder strip material according to claim 1, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

7. An electrical contact material with a solder layer prepared by the preparation method according to claim 1.

8. The electrical contact material with the solder layer prepared by the preparation method according to claim 7, wherein in the second step, the solder strip material is stuck in the stuck slot of the long silver-graphite sheet material for the sintering to achieve the rapid composite.

9. The electrical contact material with the solder layer prepared by the preparation method according to claim 8, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

10. The electrical contact material with the solder layer prepared by the preparation method according to claim 7, wherein the silver-graphite electrical contact sheet material has a length of 5-50 m.

11. The electrical contact material with the solder layer prepared by the preparation method according to claim 10, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

12. The electrical contact material with the solder layer prepared by the preparation method according to claim 7, wherein after the composite of the long silver-graphite electrical contact material and the solder strip material is completed, a punching is further performed to obtain an electrical contact material with a solder layer; and the punching is to punch the silver-graphite material rolled to a desired thickness of the finished product into a desired outer dimension.

* * * * *